US009302380B2

(12) United States Patent
Weaver

(10) Patent No.: US 9,302,380 B2
(45) Date of Patent: Apr. 5, 2016

(54) SEAT PULLER

(71) Applicant: Samuel Weaver, Adamsville, OH (US)

(72) Inventor: Samuel Weaver, Adamsville, OH (US)

(73) Assignee: Samuel Weaver, Adamville, OH (US)

( * ) Notice: Subject to any disclaimer, the term of this patent is extended or adjusted under 35 U.S.C. 154(b) by 0 days.

(21) Appl. No.: 14/680,491

(22) Filed: Apr. 7, 2015

(65) Prior Publication Data

US 2015/0283689 A1 Oct. 8, 2015

Related U.S. Application Data

(60) Provisional application No. 61/976,164, filed on Apr. 7, 2014.

(51) Int. Cl.

| | |
|---|---|
| ***B25B 27/24*** | (2006.01) |
| ***B25B 27/26*** | (2006.01) |
| ***B25B 27/02*** | (2006.01) |
| ***B25B 27/06*** | (2006.01) |

(52) U.S. Cl.

CPC ..... *B25B 27/26* (2013.01); *B25B 27/023* (2013.01); *B25B 27/062* (2013.01); *Y10T 29/49407* (2015.01); *Y10T 29/49815* (2015.01); *Y10T 29/49822* (2015.01); *Y10T 29/53596* (2015.01); *Y10T 29/53874* (2015.01); *Y10T 29/53891* (2015.01)

(58) Field of Classification Search

CPC ..... B25B 27/24; B25B 27/26; B25B 27/023; B25B 27/062; Y10T 29/49822; Y10T 29/49815; Y10T 29/53874; Y10T 29/53891

See application file for complete search history.

(56) References Cited

U.S. PATENT DOCUMENTS

| | | | | |
|---|---|---|---|---|
| 1,492,877 | A * | 5/1924 | Davis | 29/266 |
| 1,553,171 | A | 9/1925 | Jones | |
| 1,598,887 | A | 9/1926 | Smith | |
| 1,650,023 | A | 11/1927 | Maxwell | |
| 1,652,857 | A | 12/1927 | Greve | |
| 1,726,187 | A | 8/1929 | Mahan | |
| 2,036,665 | A | 4/1936 | White et al. | |
| 3,029,501 | A | 4/1962 | Leathers | |
| 3,990,139 | A | 11/1976 | Touchet | |
| 5,533,245 | A | 7/1996 | Stanton | |
| 2011/0173814 | A1 | 7/2011 | Patel | |

OTHER PUBLICATIONS

Hydraulic Fracturing Operations—Well Construction and Integrity Guidelines, API Guidance Document HF1, First Edition, Oct. 2009.

* cited by examiner

*Primary Examiner* — John C Hong

(74) *Attorney, Agent, or Firm* — Young Basile Hanlon & MacFarlane P.C.

(57) ABSTRACT

A seat puller removes a valve seat or bushing from a structure such as a fluid pump. The seat puller may be formed of a shaft having a threaded adjusting nut fastening region, a central shaft region, a land region, a cone shaft region and an end stopper region. The seat puller includes a slide lock jaw held onto the shaft at the land region by a spring. The spring permits the slide lock jaw to open slightly and thereby permits the slide lock jaw to slide down the shaft to the cone shaft region. This causes the slide lock jaw to open and engage the internal and bottom surfaces of a seat with its outer circumference, thereby permitting the seat puller to remove the seat from the structure in which it is seated.

20 Claims, 9 Drawing Sheets

FIG. 6
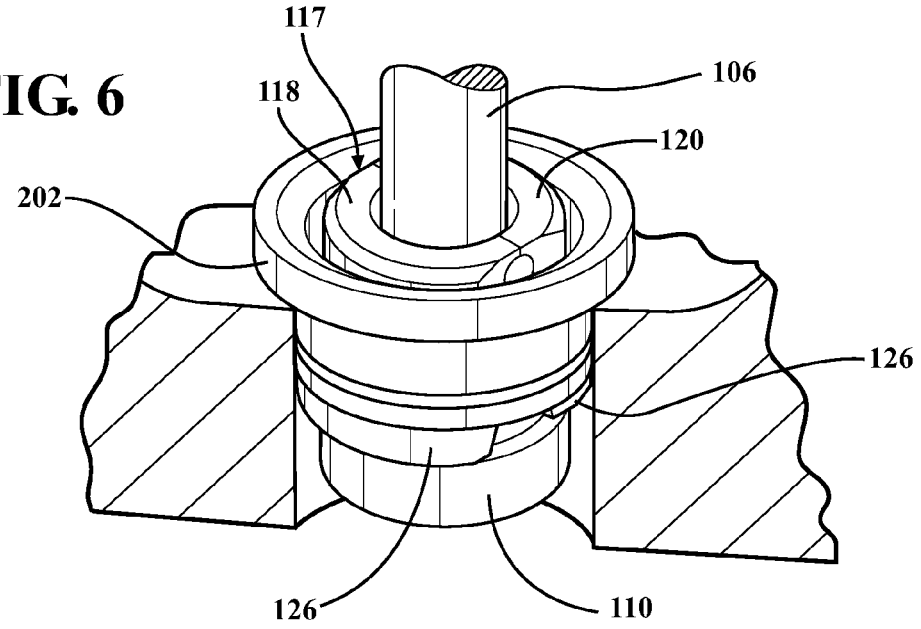
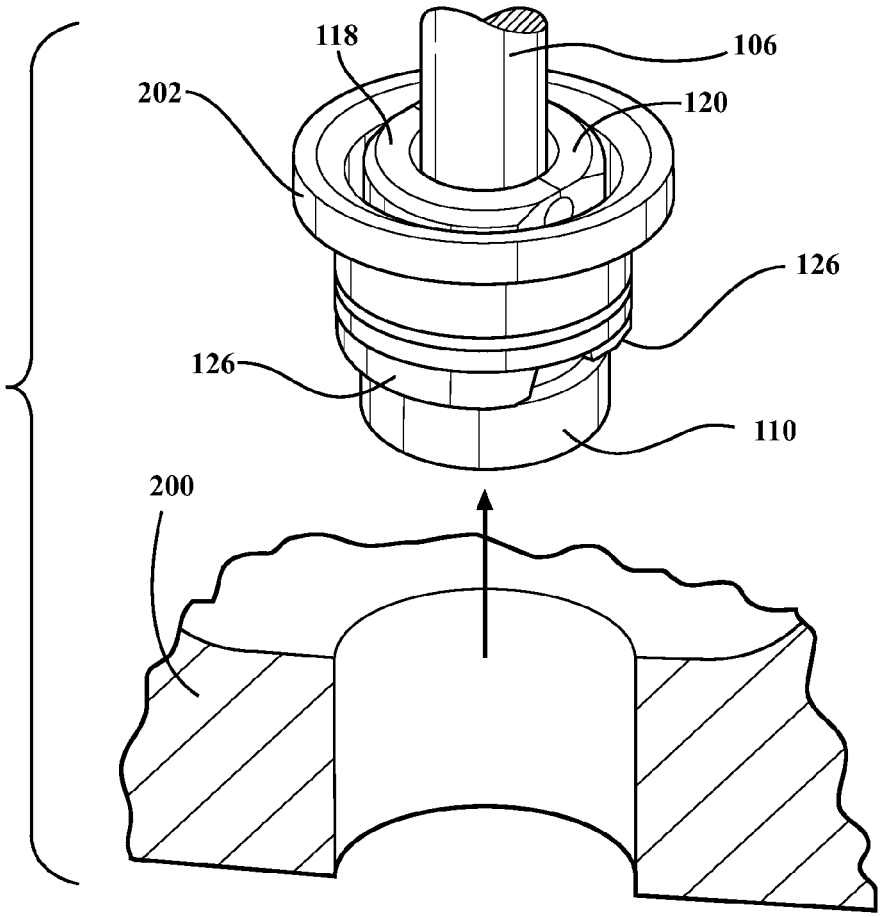
FIG. 7

SEAT PULLER

CROSS-REFERENCE TO RELATED APPLICATION

This application claims priority to U.S. Provisional Application No. 61/976,164, filed Apr. 7, 2014, which is incorporated herein in its entirety by reference.

TECHNICAL FIELD

This disclosure relates in general to mechanical pullers for removing annular seats fit into openings.

BACKGROUND

A seat can be defined as an annular part designed to fit into an opening and provide a mating surface for another part. Seats may be made of a metal such as steel, or other material designed to withstand wear. A seat may have a slightly tapered outer diameter designed to be interference fit with a structure such as a pump housing. Its inner diameter may have a frusto-conical section designed to receive a valve of a pump to form a substantially leak-free joint with the valve.

Large volume, high-capacity pumps can have primary structures formed from, for example, cast iron. Pumps constructed in this fashion are used in the oil or natural gas extraction industries to pump drilling fluids to a well hole. Such pumps use check valves, for example, to permit one-way flow of fluids into and out of the pumping chamber, thereby permitting the pump to operate. Check valves operate by sealing and unsealing an opening using a caged, spring loaded check ball, which can be steel, for example. The check valve generally closes by pressing the check ball into the seat by means of the spring pressure. In this way, the seat and check ball may provide a substantially leak-proof seal.

BRIEF SUMMARY

In an arrangement such as described above, fluid pressure on the check valve from a first direction presses the check ball more firmly into the seat, inhibiting fluid flow through the opening of the seat of the check valve. Fluid pressure against the check ball from a second direction can overcome the spring pressure permitting fluid to flow through the opening. A pair of check valves installed in opposite directions in a pump chamber can operate by permitting the check valves to open and close to permit fluid to flow into and out of one way through the check valve in response to pressure created by a reciprocating piston, for example.

Abrasive liquids and hammering caused by repeated opening and closing the check valve can reduce the efficacy of the seal between the check ball and the seat. For example, in the natural gas extraction field, drilling fluids including water can be pumped into the drilled hole to assist drilling and natural gas extraction using pumps having cast iron bodies and check valves. The drilling fluids may contain abrasives, such as sand. The abrasive nature of the fluid being handled can cause wear on the seat, in turn causing the seal between it and the check ball to leak and/or fail. In addition, hammering can cause the seat to become deeply embedded in the material in which it is installed.

For these reasons, it is desirable to replace the seat either periodically or on another basis, such as in response to a visual inspection. In some applications, however, access may be obtained from only one end of seat. Further, the seat may be embedded within concrete or cast iron, for example, due to hammering. Each of these makes it difficult to remove the seat.

A slide lock jaw that can be used for removing the seat is described herein. The slide lock jaw includes a first half jaw and a second half jaw, each of the first half jaw and the second half jaw having a first end and a second end opposite to the first end and having a first wall and a second wall each extending between the first end and the second end. The slide lock jaw has a first, closed position whereby the first wall of the first half jaw faces and is in contact with the first wall of the second half jaw, and the second wall of the first half jaw faces and is in contact with the second wall of the second half jaw. The slide lock jaw has a second, open position whereby the first wall of the first half jaw faces and is spaced further apart from the first wall of the second half jaw at the second end than the first end, and the second wall of the first half jaw faces and is spaced further apart from the first wall of the second half jaw at the second end than the first end. The first half jaw includes a pivot extending from at least one of the first wall or the second wall near the first end of the first half jaw for engagement with a notch within the corresponding at least one of the first wall or the second wall of the second half jaw. Alternatively or additionally, the second half jaw includes a pivot extending from at least one of the first wall or the second wall near the first end of the second half jaw for engagement with a notch within the corresponding at least one of the first wall or the second wall of the first half jaw. An interior surface of each of the first half jaw and the second half jaw is at least partially conical in shape such that an opening extends completely through the first end and the second end both when the slide lock jaw is in the first, closed position and when the slide lock jaw is in the second, open position. The slide lock jaws can form part of a seat puller.

One implementation of a seat puller described herein includes a shaft formed as a single unit that includes an adjusting nut fastening region, a central shaft region, a land region, a cone shaft region and an end stopper region. The seat puller further includes an adjusting nut threadingly attached to the shaft at the adjusting nut fastening region, a drop stop collar attached to the shaft at the central shaft region, and a slide lock jaw. The slide lock jaw includes two half jaws, each having interior regions shaped to match the cone shaft region. The slide lock jaw also includes at least one pivot and a keeper spring, and is assembled onto the shaft so that the keeper spring causes the two half jaws to be held slidingly against the shaft at the land region and the cone shaft region. The slide lock jaw slides to a position at the land region to permit the seat puller to be positioned in a seat. Positioning the slide lock jaw in a seat and moving the shaft with respect to the seat permits the slide lock jaw to slide from the land region to the cone shaft region wherein the interior regions of the slide lock jaw follow the shape of the cone shaft region and thereby expand against the keeper spring. This increases the diameter of the slide lock jaw, thereby capturing the seat with the exterior surface of the slide lock jaw.

Another implementation of the seat puller described herein a shaft having a circular outer circumference and a slide lock jaw. The shaft includes a central shaft region, a land region extending from the central shaft region, a cone shaft region extending from the land region, and an end stopper region about a circumference of an end of the cone shaft region opposite from the land region. The slide lock jaw includes two half jaws, a pivot and a keeper spring. Each half jaw has an interior surface shaped to match an external surface of the cone shaft region. The slide lock jaw is slidingly held against the shaft for rotation about the pivot by engagement of the keeper spring with each of the two half jaws such that the slide lock jaw has a first, closed position in sliding engagement with the land region and a second, open position in sliding engagement with the cone shaft region and in contact with the end stopper region.

One method described herein includes inserting a slide lock jaw through a first end of an annular seal affixed to a housing wherein the slide lock jaw is mounted on a shaft having a circular outer circumference. The shaft includes a central shaft region, a land region extending from the central shaft region, a cone shaft region extending from the land region, and an end stopper region about a circumference of an end of the cone shaft region opposite from the land region. The slide lock jaw includes two half jaws, a pivot and a keeper spring, each half jaw having an interior surface shaped to match an external surface of the cone shaft region and the slide lock jaw is slidingly held against the shaft for rotation about the pivot by engagement of the keeper spring with each of the two half jaws. The method also includes extending the shaft toward the annular seal until the end stopper region extends from a second end of the annular seal while the slide lock jaw is in a first, closed position in sliding engagement with the land region, raising the shaft away from the annular seal until the slide lock jaw is in a second, open position in sliding engagement with the cone shaft region and in contact with the end stopper region, an outer circumference of the slide lock jaw in contact with the internal surface of the annular seal, and removing the shaft and the annular seal from the housing while the slide lock jaw is in the second, open position.

Details of and variations in these embodiments and others are described in more detail below.

BRIEF DESCRIPTION OF THE DRAWINGS

The description herein makes reference to the accompanying drawings wherein like reference numerals refer to like parts throughout the several views, and wherein:

FIG. 6 is a side view of the cone shaft region, end stopper region and slide lock jaw in position within the seat of FIG. 3 to begin pulling the seat;

FIG. 7 is a side view of the cone shaft region, end stopper region and slide lock jaw in position within the seat of FIG. 3 after pulling the seat;

DETAILED DESCRIPTION

Annular seats or bushings can be used in pumps and other fluid handling equipment to provide a sealing surface a check valve ball. Seats may be generally radially symmetric with an outer diameter, a central bore and a frusto-conical section forming a sealing surface near or at the edge formed by the top surface and the central bore. The seat can be machined from a metallic material, such as steel, for example. The seat may be inserted into a structure or body as part of a pump mechanism, for example.

As mentioned above, drilling (e.g., fracking) fluids and other materials pumped through the check valve having a seat may be highly abrasive, causing wear on the seat and subsequent leakage. This makes it desirable to replace seats on a regular basis, but this can be difficult. With respect to valve seats, for example, one difficulty is that the repeated operation of the valve can press the seat more firmly into the structure holding it. Such operations may use pressures up to about 9000 psi. Another is that access to the seat may only be made from one direction. The seat puller described herein permits a seat to be easily and quickly removed from a body in which the seat has been inserted where access to the seat is available only from one side. In instances where it is determined that a seat resists being removed using the seat puller, the seat puller can be quickly and easily removed from the seat and the body without requiring further disassembly.

Figure 1:
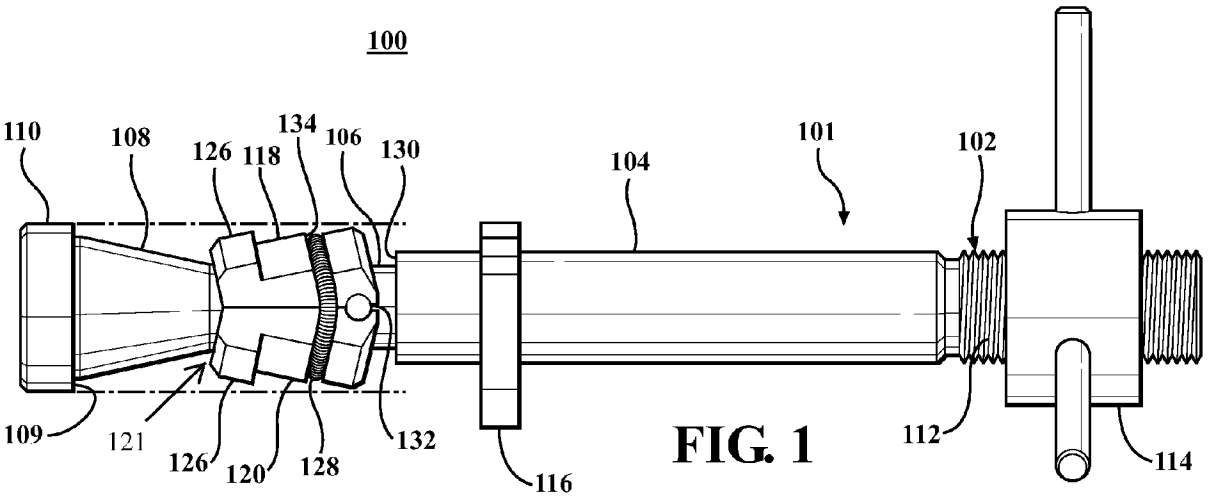
FIG. 1 is a side view of a seat puller in a first configuration according to one implementation of the teachings herein.
Figure 2:
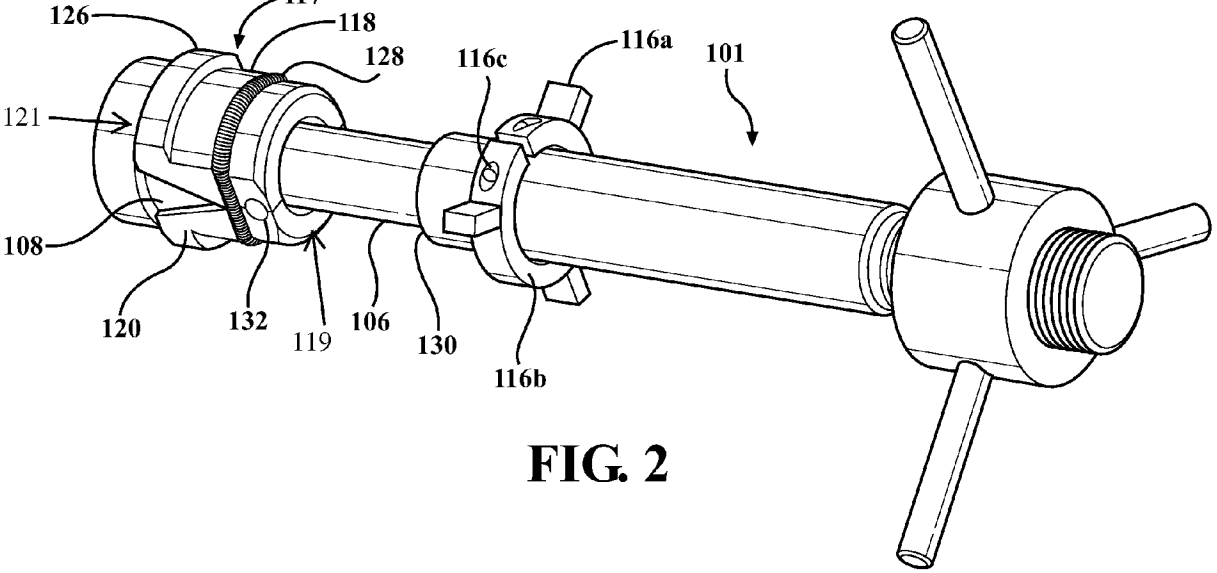
FIG. 2 is a perspective view of the seat puller of FIG. 1 in a second configuration.

Referring first to FIGS. 1 and 2, shown is a seat puller 100 including a seat puller shaft 101 having an adjusting nut fastening region 102, a central shaft region 104, a land region 106, a cone shaft region 108 and an end stopper region 110. The adjusting nut fastening region 102 can have threads 112 onto which an adjusting nut 114 is threaded. The adjusting nut 114 can also be fastened to the nut fastening region 102 by any one of a variety of known methods. The central shaft region 104 may optionally have a drop stop collar 116 attached. In this case, the drop stop collar 116 can be machined in two sections 116*a*, 116*b* that fit tightly around the central shaft region 104 when the two sections are bolted together through a bolt hole 116*c* Like the drop stop collar 116, the adjusting nut fastening region 102 and its associated adjusting nut 114 are optional. The functions of these components will be discussed further below.

The shaft 101 can be machined from a billet of steel, for example, in order to form the shaft 101 as a single unit. The shaft 101 can also be manufactured as two or more units and fastened together to form the shaft 101. Shaft 101 can be formed from steel, for example, in order to obtain the strength required to pull seats in certain implementations. Other materials are possible as long as they are strong enough for the implementation. Shaft 101 may be hollow in certain implementations.

For ease of explanation, the end of the seat puller 100 having the nut fastening region 102 will be called the "top" of the seat puller 100 and the end of the seat puller 100 having the end stopper region 110 will be referred to as the "bottom" of the seat puller 100. Movement towards the top of the seat puller 100 will be referred to as moving "up" and movement towards the bottom of the seat puller 100 will be referred to as moving "down". These directions are for explanatory purposes only. The seat puller 100 may be used in any orientation depending on the seat position of the seat into which it is to be inserted.

In addition to the shaft 101, the seat puller 100 also has slide lock jaw 117 formed of a pair of half jaws 118, 120. The first end 119 of the slide lock jaw 117 is referred to as the top hereinafter, while the second end 121 of the slide lock jaw 117 is referred to as the bottom hereinafter. The exterior surfaces of the half jaws 118, 120 relative to the shaft 101 include dogs 126 or other flange portions that engage the bottom surface of the seat to be pulled as discussed in more detail hereinafter. The half jaws 118, 120 have smooth, curved interior surfaces for sliding engagement with the cone shaft region 108. The interior surfaces of the half jaws 118, 120 are curved so that, when mounted on the shaft 101, the inner diameter formed by the joined half jaws 118, 120 loosely fits about the diameter of the land region 106 in at least the top portion of the interior surfaces. In the implementation shown in FIGS. 1 and 2, the interior surfaces of half jaws 118, 120 each form a semi-conical shape that is narrower at the top and wider at the bottom. The half jaws 118, 120 are not permanently mounted or attached to any portion of seat puller shaft 101. The slide lock jaw 117 may be formed by positioning half jaws 118, 120 around the land region 106 of the seat puller shaft 101 and holding them together Using a spring 128. In this way the slide lock jaw 117 is free to move along the land region 106 and, by expanding the half jaws 118, 120 against the spring 128 pressure, onto cone shaft region 108.

When in the expanded position on the cone shaft region 108, the half jaws 118, 120 are held in position by spring 128 and prevented from falling off the end of the seat puller shaft 101 by a shelf or flange 109 formed by the end stopper region 110 and the pressing action of half jaws 118, 120 together in the area closest to the central shaft region 104. The slide lock jaw 117 may be prevented from riding up on the central shaft region 104 by a step edge 130 between the land region 106 and the central shaft region 104, but the step edge 130 is not required. In one implementation, the spring 128 is fitted within a slot or groove 134 machined into the external surface of each of the half jaws 118, 120 about the outer circumference of the slide lock jaw 117. Other ways of securing the spring 128 to the half jaws 118, 120 that do not allow the spring 128 to move along the length of the slide lock jaw 117 may be used.

Half jaws 118, 120 have a pivot 132 between them located adjacent to the top of the slide lock jaw 117 when installed. The spring 128 is located just below pivot 132, but it could be located lower down the slide lock jaw 117 as long as it does not interfere with engagement of the slide lock jaw 117 with the seat to be removed. The pivot 132 can be formed by adding a short cylindrical section to opposite sides of one of the half jaws, for example half jaw 118, and removing corresponding half-cylindrical sections from the other half jaw 120 to permit the two half jaws 118, 120 to open and close using the pivot 132 as a hinge. The two half jaws 118, 120, when held in place on at the land region 106 by the spring 128 can move about the pivot 132 thereby permitting the slide lock jaw 117 to lightly grip the land region 106 and thereby be prevented from sliding down the land region 106 to the cone shaft region 108. Since the slide lock jaw 117 grips the land region 106 with pressure from the spring 128, a small amount of downward force on the half jaws 118, 120 can permit them to open slightly by pivoting on pivot 132, opening the half jaws 118, 120 against the pressure of the spring 128 and thereby slide down onto the cone shaft region 108. The pivot 132 allows the half jaws 118, 120 to be held to each other and to the seat puller shaft 101 only by the pressure of the spring 128 around the diameter of the slide lock jaw 117. This lack of fixed coupling, such as through welding or other means, allows for easy disassembly and assembly of the seat puller 100.

FIG. 1 shows the seat puller 100 with the half jaws 118, 120 held in position at the land region 106 by spring 128. In this compressed position, the half jaws 118, 120 are held against the land region 106 so that the seat puller 100 including the half jaws 118, 120 can be inserted into a seat. Once the seat puller 100 is inserted into a seat, the slide lock jaw 117 slides down the seat puller shaft 101 into a position as shown in FIG. 2 using the seat to guide the half jaws 118, 120. In FIG. 2, the half jaws 118, 120 have been slid into a position at the cone shaft region 108 of the seat puller shaft 101. The shape of the cone shaft region 108 expands the half jaws 118, 120 on the pivot 132 against the pressure of the spring 128, permitting the slide lock jaw 117 to grip the opposing side of the seat against dogs 126.

Figure 3:
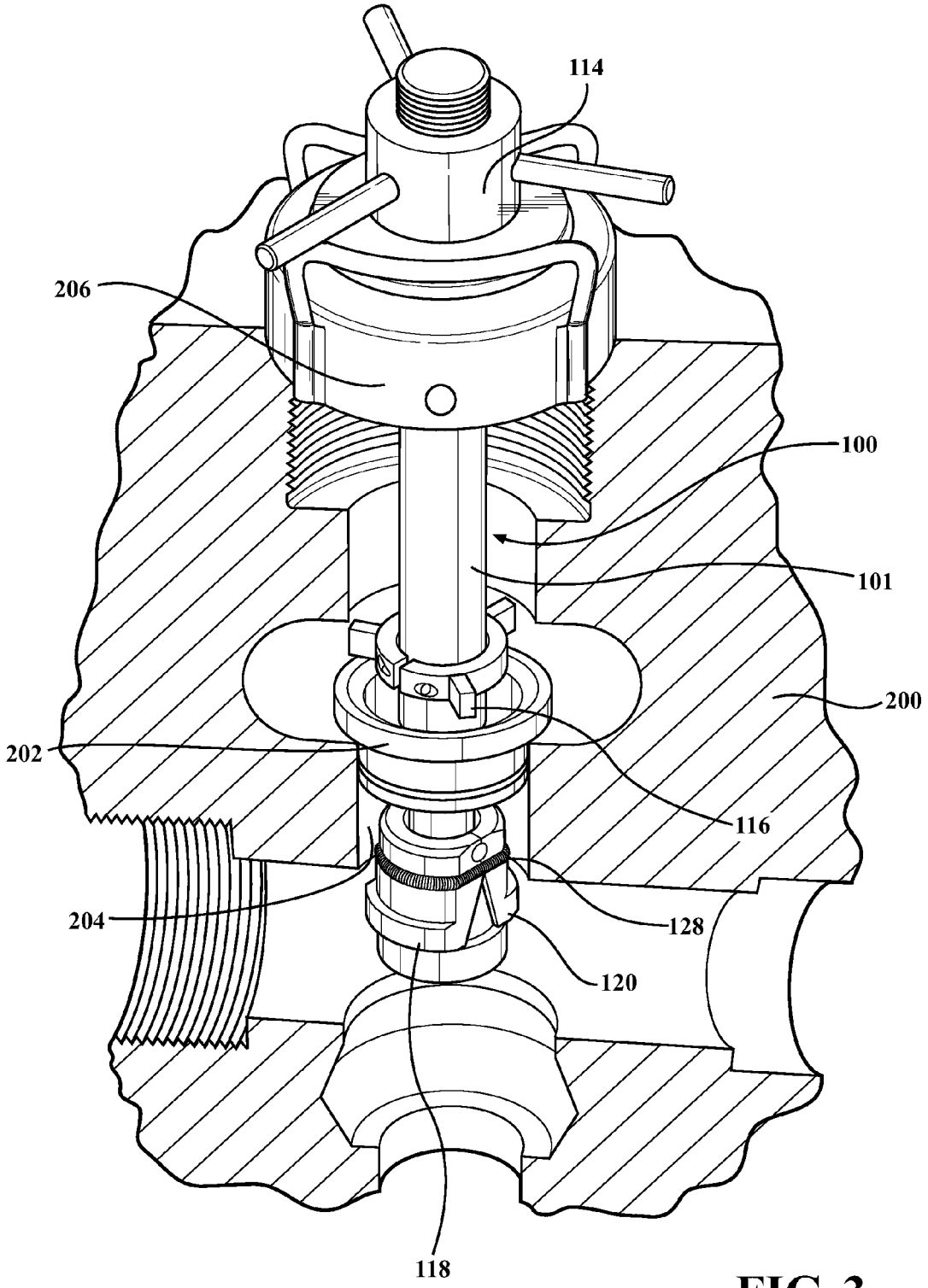
FIG. 3 is a side view of the seat puller of FIG. 1 with the cone shaft region and the slide lock jaw inserted through a seat of a cast iron pump body.

FIG. 3 shows a partial cutaway cross-section of a cast iron pump body 200 having a seat 202 inserted into a passage 204. Seat 202 and passage 204 can be designed to be an interference fit, wherein the seat 202 is forcibly inserted into passage 204 to prevent leaks between seat 202 and passage 204. In addition, forces present during operation generally tend to press the seat 202 more firmly into the passage 204, thereby making the seat 202 difficult to remove from the cast iron pump body 200.

The seat puller 100 is shown inserted through the seat 202. Specifically, the half jaws 118, 120 have slid to a position on the cone shaft region 108 against the end stopper region 110 and are held in position by spring 128. During insertion, which may be done by hand, the seat puller 100 may be prevented from falling through the seat 202 by the drop stop collar 116, if present. After insertion, a hydraulic pancake jack 206 can be fitted over the seat puller shaft 101 and held in place by tightening the adjusting nut 114 to pull the half jaws 118, 120 firmly into the seat 202. Actuating the hydraulic pancake jack 206 expands the hydraulic pancake jack 206 between the cast iron pump body 200 and the adjusting nut 114. When the adjusting nut 114 is adjusted to take substantially all of the slack out of the seat puller 100 and cast iron pump body 200 assembly, actuating the hydraulic pancake jack 206 applies upwards pressure on the adjusting nut 114 and consequently removes seat 202 from the passage 204. For example, it may take 70 tons of pull pressure to remove seat 202.

FIGS. 4-7 are expanded views of the seat puller 100 being inserted into the seat 202, engaging the seat 202 and removing the seat 202.

Figure 4:
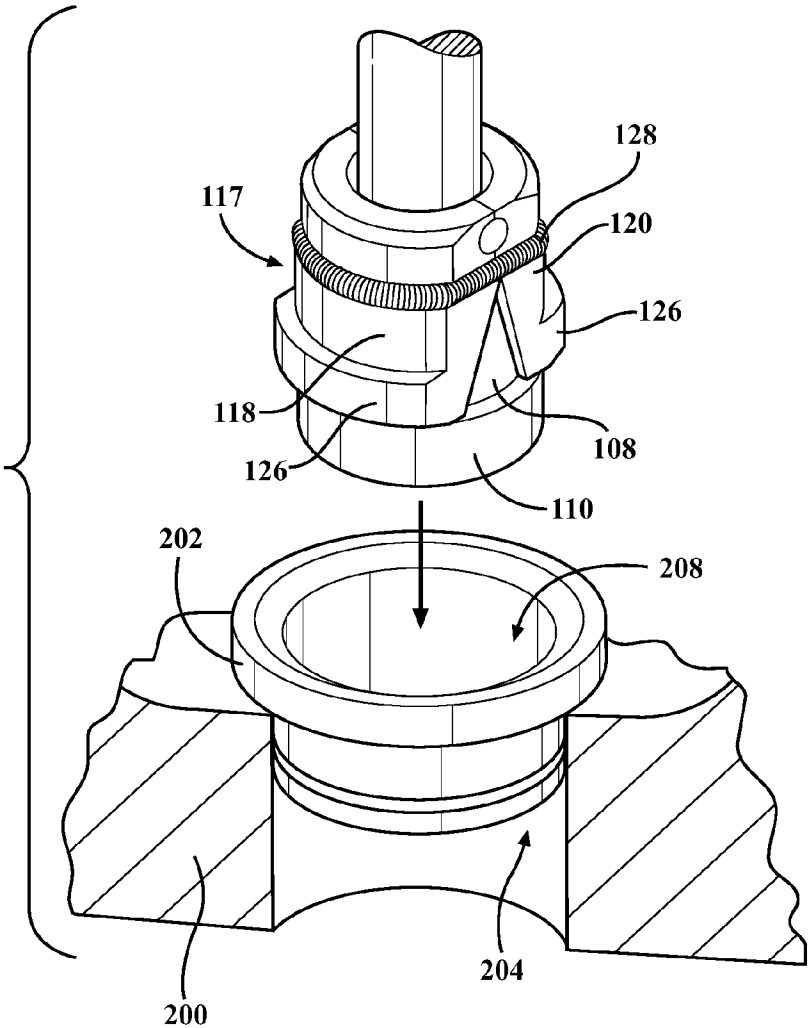
FIG. 4 is a side view of the cone shaft region, end shaft region and slide lock jaw before insertion through the seat of FIG. 3.

In FIG. 4, the end stopper region 110, the cone shaft region 108 and slide lock jaw 117 are shown before insertion through a bore or opening 208 of the seat 202. When the half jaws 118, 120 have pivoted on pivot 132 and thus have slid down around the cone shaft region 108 to the end stopper region 110 as shown, they are too wide to fit through the bore 208 of the seat 202. Pushing the seat puller shaft 101 through the seat 202 pushes the slide lock jaw 117 back up the seat puller shaft 101 to the land region 106 due to the contact of the dogs 126 with the outer circumference of the bore 208. The land region 106 has a smaller diameter than at least the bottom portion of the cone shaft region 108, so the pressure of the spring 128 causes the half jaws 118, 120 to pivot on pivot 132 and move closer to the land region 106, thereby permitting the slide lock jaw 117 to pass through the bore 208 of the seat 202 due to the contraction of the dogs 126 and the resulting smaller outer diameter of the slide lock jaw 117.

Figure 5:
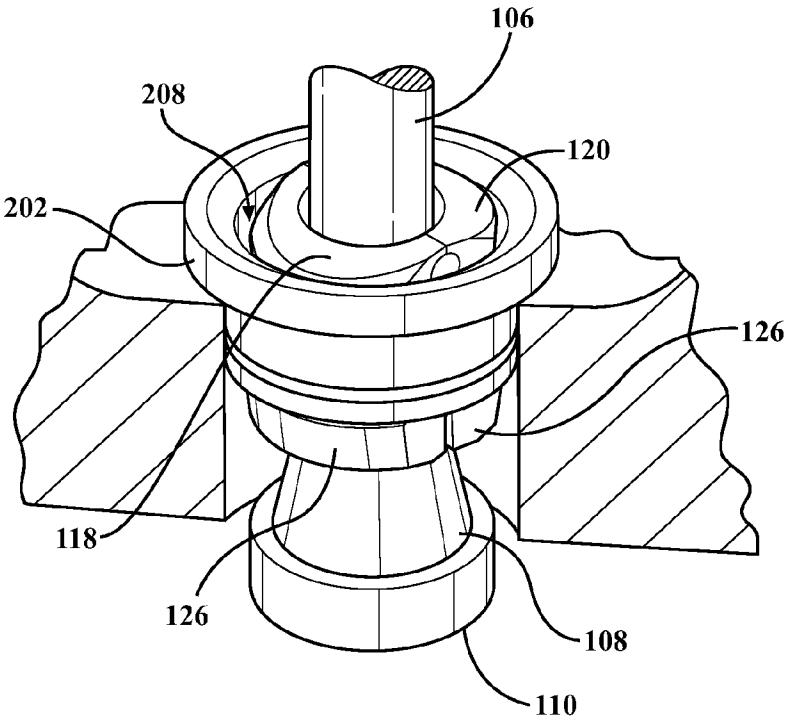
FIG. 5 is a side view of the slide lock jaw located within the opening of the seat of FIG. 3 and the cone shaft region and end stopper region extending below the seat of FIG. 3.

As shown in FIG. 5, further downward action of the seat puller shaft 101 results in the end stopper region 110 and the cone shaft region 108 being inserted completely through the seat 202 to extend below the seat 202 at the side opposite from the insertion side. The half jaws 118, 120 can be seen in the bore 208 of the seat 202 in a position close to the land region 106 due to the pressure of the spring 128.

FIG. 6 shows the seat puller shaft 101 having been raised to a position to prepare to pull seat 202. Raising the seat puller shaft 101 can cause the slide lock jaw 117, including the half jaws 118, 120 and spring 128, to slide down the land region 106 to the cone shaft region 108, thereby expanding the half jaws 118, 120 around pivot 132 against the pressure of the spring 128 to permit the dogs 126 to engage the bottom of seat 202. When the slide lock jaw 117 reaches the end stopper region 110, further upward pressure on the seat puller shaft 101 presses the half jaws 118, 120 more firmly against the seat 202. From this position, the seat puller 100 is prepared to pull the seat 202. Further upwards pressure on the seat puller shaft 101 will cause the end stopper region 110 to apply upwards pressure on the slide lock jaw 117. Since the dogs 126 are engaged with the seat 202, upwards pressure on the half jaws 118, 120 dislodges the seat 202 from the cast iron pump housing 200, for example by using the hydraulic pancake jack 206 or other means such as a jack or further tightening adjusting nut 114.

FIG. 7 shows the seat 202 after being dislodged from the cast iron pump housing 200. As the seat puller shaft 101 is raised, the seat 202 is raised free of the cast iron pump housing 200. The entire seat puller 100 including the seat 202 can then be removed from the pump housing 200 to permit a new seat to be installed in the pump housing 200. In this implementation, the seat puller 100 and seat 202 may be removed by unscrewing the adjusting nut 114 from the adjusting nut fastening region 102, removing the hydraulic pancake jack 206, and removing the seat puller shaft 101 with the seat 202 and the slide lock jaw 117. These may be manual operations.

Although the seat puller shaft 101 includes the adjusting nut fastening region 102, this is not required. It is desirable when coupling of the seat puller shaft 101 with a jack as shown herein due to the need for forces that exceed those possible by an unaided human in the example application described herein. When a source of force other than a human is needed (e.g., an actuator) to move the shaft up and down, other coupling devices and connections may be used depending on the actuator. Further, when only human force is needed in other applications of the seat puller 100, handles or other gripping means may be provided at the upper end of the seat puller shaft 101.

According to the construction described herein, the seat puller has the ability to be extricated from a seat in the event that the seat is unable to be removed from the structure into which it is assembled. In some cases, a seat can be inserted into position with sufficient force such that attempting to extricate it with a seat puller is not successful. With some seat pullers, once the seat puller is engaged with a seat, the seat must be pulled or else the seat puller cannot be removed without disassembling the unit completely to remove the seat and seat puller.

In contrast, the seat puller 100 described herein may be removed from a seat once it is engaged if the seat proves too difficult to remove. With reference to FIGS. 3-7, this can be accomplished by loosening the adjusting nut 114 to permit the seat puller shaft 101 to drop into a position similar to that shown in FIG. 5, where the cone shaft region 108 has dropped clear of the seat 202. At this point the slide lock jaw 117 can still be proximate to the seat 202. The slide lock jaw 117 will also be proximate to the land region 106 since the seat puller shaft 101 has been lowered with respect to the seat 202. Since the slide lock 118, 120 jaws are proximate to the land region 106 and no longer proximate to the cone shaft region 108, the spring 128 can pull the half jaws 118, 120 closer to the land region 106, thereby disengaging the dogs 126 from the seat 202.

The tension on the spring 128 holds the half jaws 118, 120 together close to the land region 106 thereby preventing the slide lock 118, 120 jaws from dropping down onto the cone shaft region 108 and spreading out. Since the tension on the spring 128 holds the half jaws 118, 120 close to the land region 106, the entire seat puller 100 can be removed from the seat 202 without requiring disassembly.

Figure 8B:
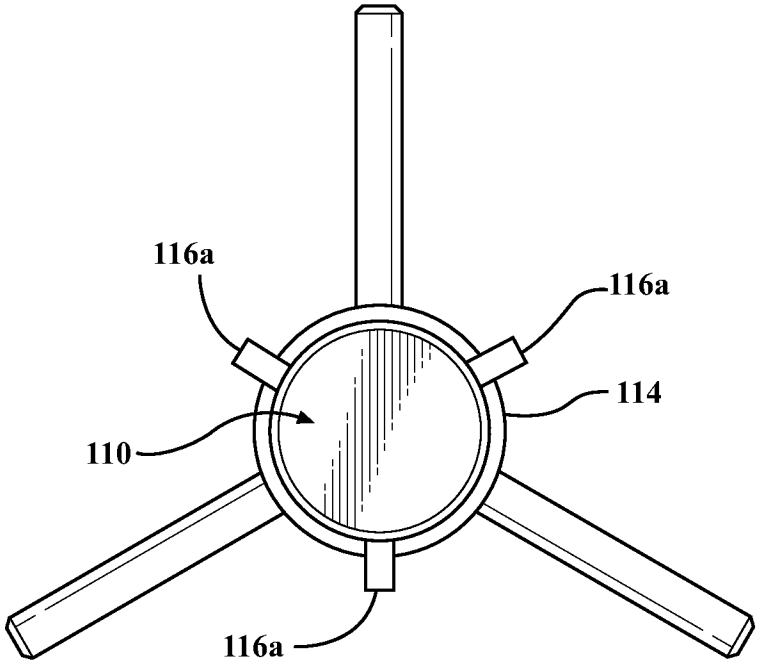
FIG. 8B is a bottom plan view from the cone shaft region of the seat puller of FIG. 1 with the slide lock jaw located at the land region.
Figure 8A:
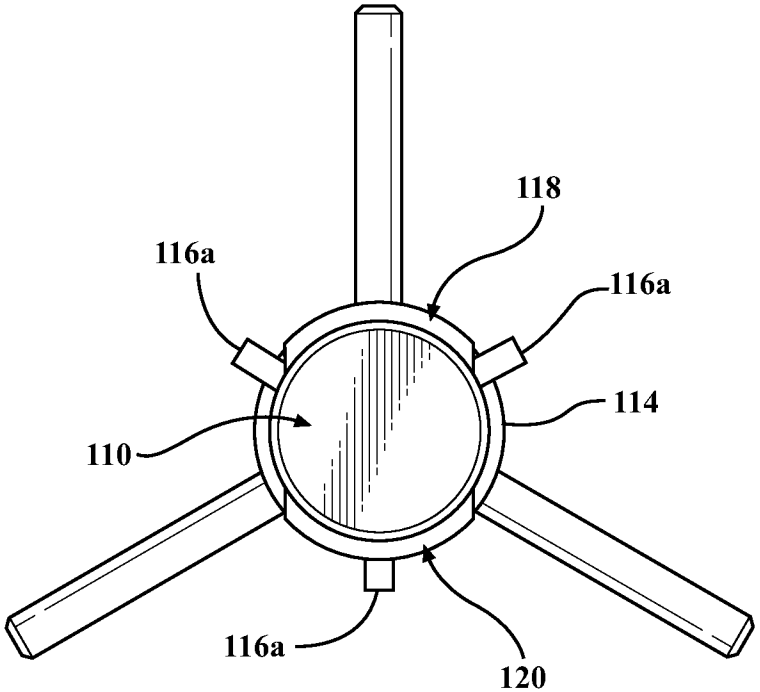
FIG. 8A is a bottom plan view from the cone shaft region of the seat puller of FIG. 1 with the slide lock jaw located at the cone shaft region.

FIG. 8A is a bottom plan view from the cone shaft region 108 of the seat puller 100 of FIG. 1 with the slide lock jaw 117 located with the cone shaft region 108, while FIG. 8B is a bottom plan view from the cone shaft region 108 of the seat puller 100 of FIG. 1 with the slide lock jaw 117 located at the land region 106. As can be seen from several figures including FIG. 1, the outside diameter of the land region 106 and the top of the cone shaft region 108 is reduced as compared to the outside diameter of the central shaft region 104. The outside diameter of end stopper region 110 may be the same as that of the central shaft region 104 or larger. In either case, the outside diameter of the land region 106 is small enough so that the widest outside diameter of the slide lock jaw 117 (that is, half jaws 118, 120) when in the first configuration shown in FIG. 1 is smaller than the outside diameter of end stopper region 110. As a result, half jaws 118, 120 are visible in the bottom view of FIG. 8B (i.e., when the slide lock jaw 117 is in the second configuration) and are not visible in the bottom view of FIG. 8A (i.e., when the slide lock jaw 117 is in the first configuration).

Figure 9:
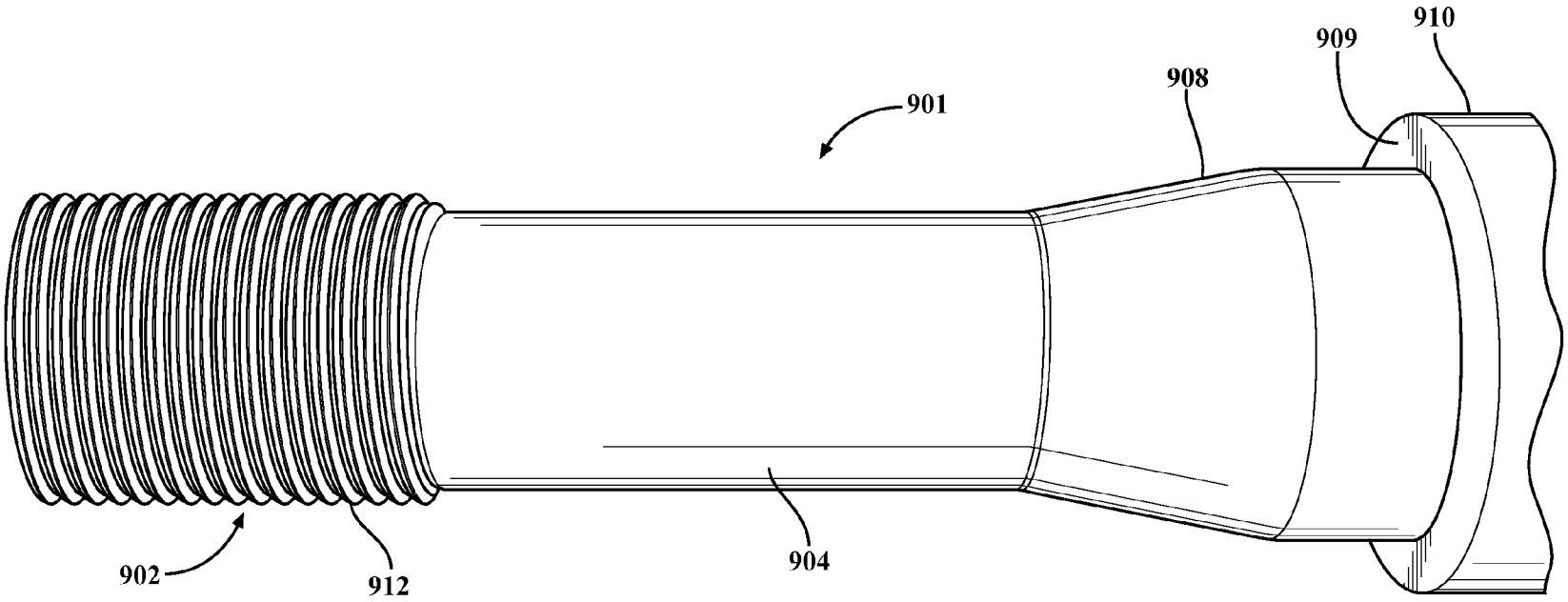
FIG. 9 is a side view of a seat puller shaft according to an alternative implementation of a seat puller according of the teachings herein.
Figure 10A:
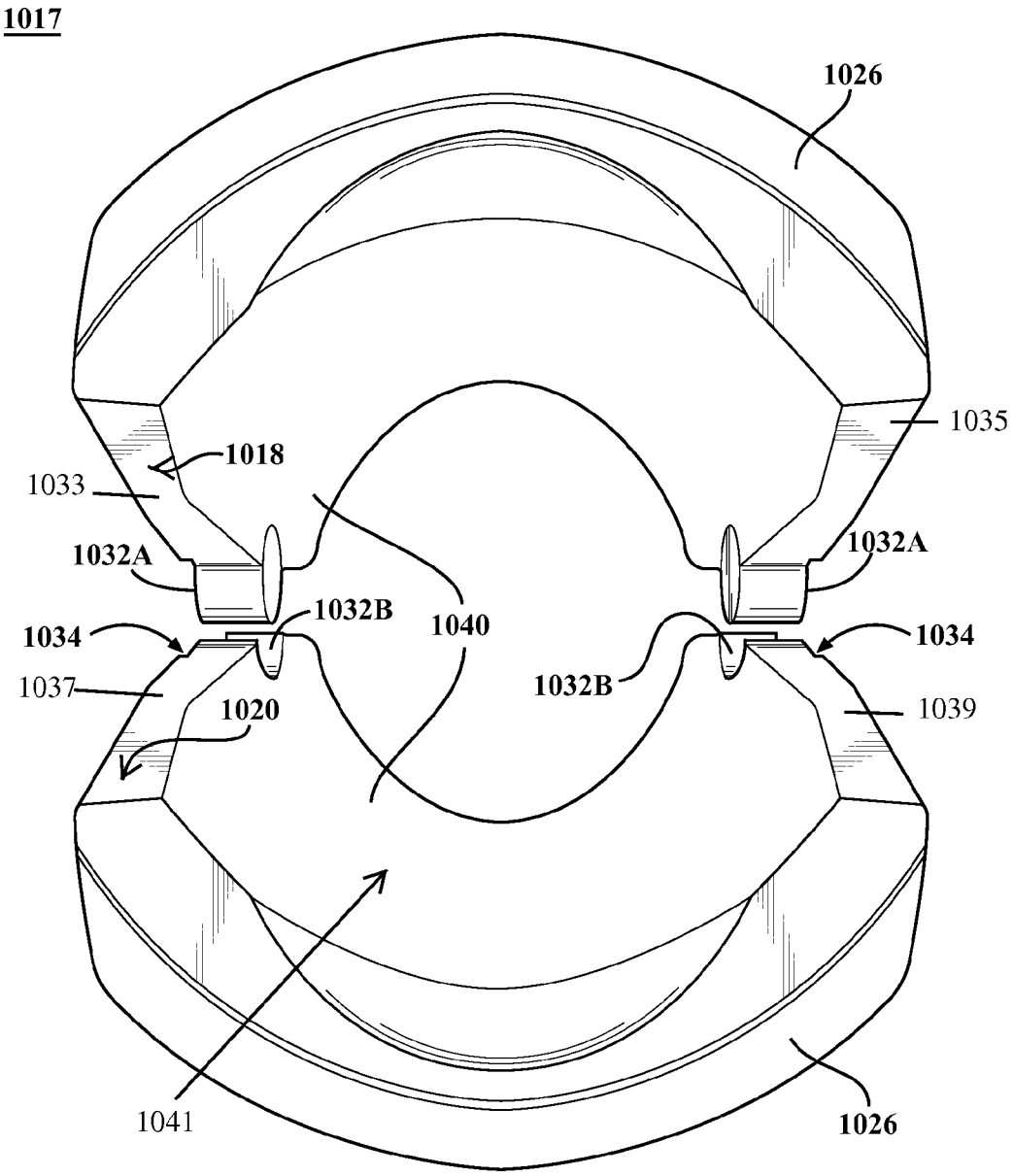
FIG. 10A is a bottom plan view of a slide lock jaw in an expanded position.
Figure 10B:
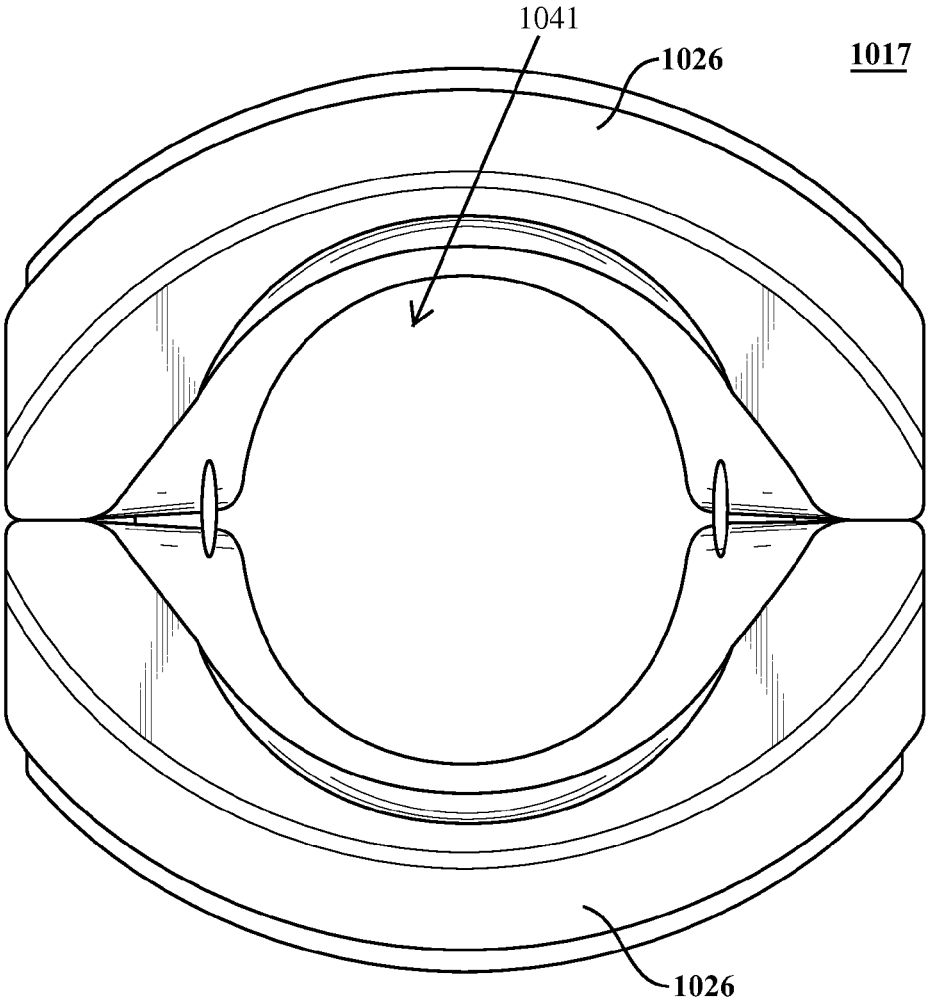
FIG. 10B is a bottom plan view of a slide lock jaw in a compressed position.
Figure 11:
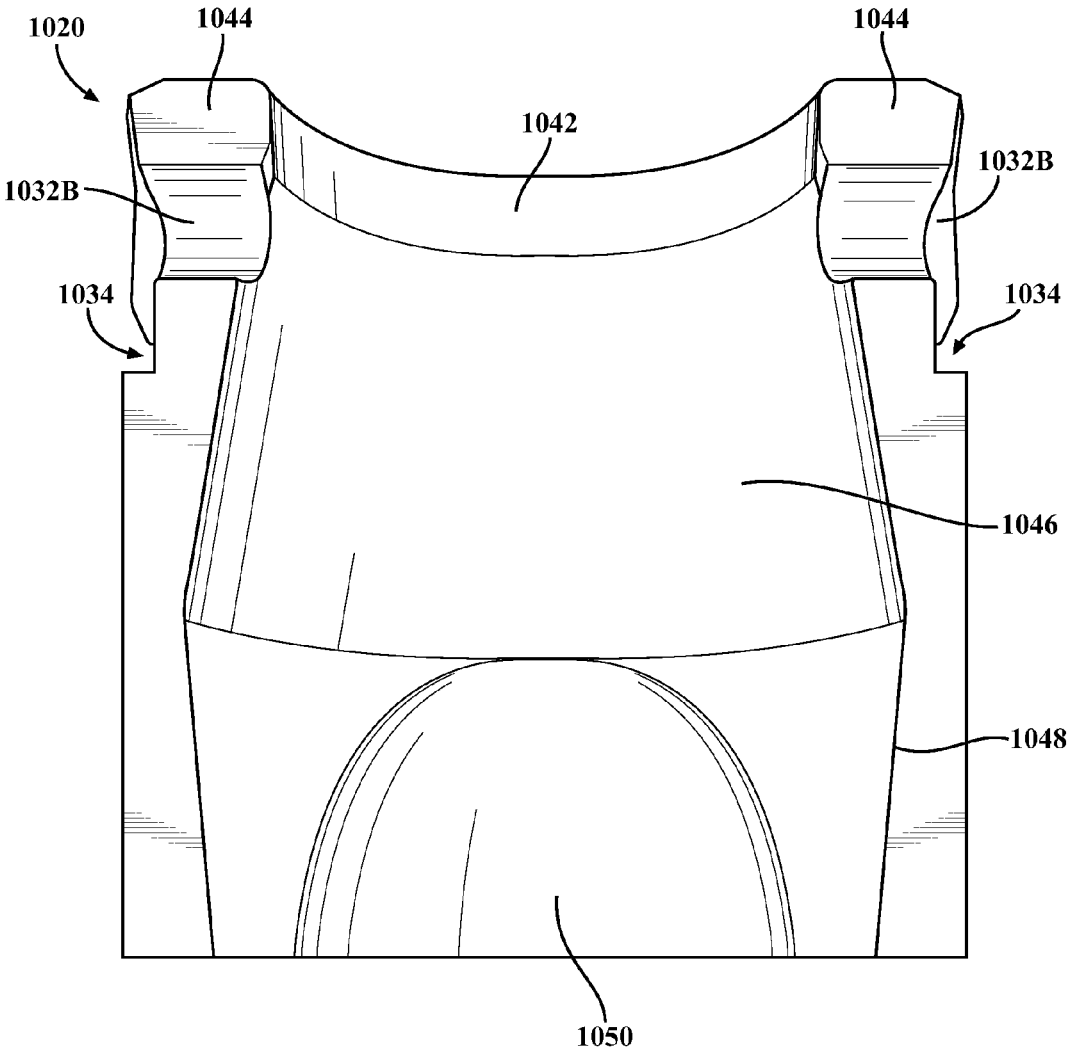
FIG. 11 is an interior plan view of one half jaw of the slide lock jaw of FIGS. 10A and 10B.

In the first embodiment or implementation described above, the outside diameter of land region 106 is smaller than the outside diameter of central shaft region 104 so as to assure that the widest outside diameter of the slide lock jaw 117 (that is, half jaws 118, 120) when in the first configuration shown in FIG. 1 is smaller than the outside diameter of end stopper region 110 while still providing relatively strong half jaws 118, 120. In some cases, however, this may result in an overall shaft strength insufficient for some applications due to the pressures involved. FIG. 9 illustrates an alternative arrangement where the land region 104 and shaft region 104 have the same outer diameter. This requires a change in the shape of the jaws as shown in FIGS. 10A, 10B and 11. This implementation operates the same as shown and described with respect to FIGS. 3-7, so no further description of those operations is provided.

FIG. 9 is a side view of a seat puller shaft 901 according to an alternative implementation of a seat puller 100 according of the teachings herein. The seat puller shaft 901 is similar to the seat puller shaft 101. That is, the seat puller shaft 901 has an adjusting nut fastening region 902 that corresponds to the adjusting nut fastening region 102, a central shaft region 904 that corresponds to the central shaft region 904, a cone shaft region 908 that performs the same functions as the cone shaft region 108 and an end stopper region 910 that corresponds to the end stopper region 110. Unlike seat puller shaft 101, the seat puller shaft 901 does not have a separately-identifiable land region 106 as the shaft 901 is a solid, one-piece shaft with a uniform outside diameter. The adjusting nut fastening region 902 can have threads 912 onto which the adjusting nut 114 previously described may be threaded. The drop stop collar 116 may also be used with the seat puller shaft 901, although it is not shown in FIG. 9 for clarity.

In the implementation of FIGS. 1 and 2, the cone shaft region 108 extends conically from the end stopper region 110 to the land region 106 (i.e., its exterior is frustoconical in shape). In the implementation of FIG. 9, however, the cone shaft region 908 forms a circular columnar shape for a portion of its length from the end stopper region 910 and then forms a frusticonical surface where it meets the central shaft region 904. The widest outer diameter of the cone shaft region 908 is wider than the outside diameter of the central shaft region 904 so that the narrowest outer diameter of the cone shaft region 908 substantially matches the outside diameter of the central shaft region 904. As can be seen from FIG. 9, a shelf or flange 909 formed by end stopper region 910 may be wider than the shelf or flange 109 formed by end stopper region 110. In this way, the diameter of the seat puller shaft 901 can be made uniform without increasing the outer diameter of end stopper region 910 beyond the outer diameter of end stopper region 110.

However, this arrangement results in a need to modify the interior shape of a slide lock jaw so that it does not extend beyond inner diameter of passage 202 and bore or opening 208 when in an open or expanded position. FIG. 10A is a bottom plan view of a slide lock jaw 1017 in this expanded position, and FIG. 10B is a bottom plan view of the slide lock jaw 1017 in a closed or compressed position.

The slide lock jaw 917 is similar to slide lock jaw 117. The slide lock jaw is formed of a pair of half jaws 1018, 1020 that perform the same functionality of half jaws 118, 120. The exterior surfaces of the half jaws 1018, 1020 relative to the shaft 901 are similar to the half jaws 118, 120. They thus include dogs 1026 or other flange portions that engage the bottom surface of the seat to be pulled as discussed above. A slot or groove 1034 (see FIG. 11) is machined into the external surface of each of the half jaws 1018, 1020 about the outer circumference for mounting the spring 128. The spring 128 is omitted from FIGS. 10A and 10B for clarify. In FIG. 10A, the half jaws are spaced apart slightly to show two pivots 1032A on opposite walls (e.g., first and second walls 1033, 1035) of half jaw 1018 that face respective notches 1032B in opposite walls (e.g., first and second walls 1037, 1039) of half jaw 1020. The half jaws 1018, 1020 have smooth, curved interior surfaces 1040 forming an opening 1041 for sliding engagement with the cone shaft region 908.

FIG. 11 shows the interior surface 1040 of the half jaw 1020, but the half jaw 1018 would be substantially the same except that the existence of pivots 1032A in place of notches 1032B. The top edge 1042 of the interior surface 1040 forms a semi-circle between the end faces. On each end face between the notch 1032B and the upper edge is a tapered surface 1044 that joins with a similar tapered surface of the half jaw 1018 when the slide lock jaw 917 is in its open position. When the slide lock jaw 917 is in its closed position, the tapered surfaces 1044 taper away from the tapered surfaces of the half jaw 1018. From the top edge 1042, the interior surface 1040 tapers into the surface gradually in a first tapered section 1046 and then, when reaching a maximum cut into the interior surface 1040, tapers gradually inward away from the surface to form a second tapered section 1048. The taper of the second tapered section 1048 is such that, when the slide lock jaw 917 is in its open position, the second tapered section 1048 of each of the half jaws 1018, 1020 form a round shape that conforms to the circular columnar shape of the cone shaft region 908. In order to fit around the wider diameter of the central shaft region 904 without substantially increasing the overall diameter of the slide lock jaw 917 while the slide lock jaw 917 is in its closed position, an additional cut-out 1050 generally conforming to the shape of the central shaft region 904.

Constructing a seat puller 100 in the fashion disclosed herein can solve certain problems presented by other seat pullers. Seat pullers that use a threaded insert to thread into a slide lock jaw assembly and thereby expand the jaws to grip the seat are operated by a user manually turning the insert until jaws are engaged. This takes a relatively long period of time in addition to being labor intensive. Moreover, such a seat puller may not provide a reliable grip on the seat for removal. The user, unable to see whether the seat is gripped, relies upon counting the number of turns made. However, contamination on the threads or cross-thread can cause the jaws to stick and rotate with the turns so they are not able to expand enough to reliably remove the seat. Seat pullers employing jaws that attach to the seat puller or each other risk getting stuck in the seat if the seat does not loosen when the seat puller is attached to the seat, potentially requiring expensive and time-consuming disassembly of the pump. Permitting the slide lock jaw to slide freely along the seat puller shaft as described herein can reduce problems caused by debris contaminating threads and prevent the seat puller from being stuck in a seat that proves impossible to remove without completely disassembling the pump. Seat puller 100 is a simple solution that may also reduce manual labor and the amount of time needed for removal of the seat. For example, the amount of time needed to remove a seat with seat puller 100 is about one quarter that needed by a seat puller with a threaded insert.

The above-described embodiments have been described in order to allow easy understanding of the present invention, and do not limit the present invention. On the contrary, the invention is intended to cover various modifications and equivalent arrangements included within the scope of the appended claims, which scope is to be accorded the broadest interpretation so as to encompass all such modifications and equivalent structures as is permitted under the law. For example, while described with reference to removing a seat in a pump body 200, seat puller 100 could be used to remove a variety of similarly shaped seats in different applications where there is no ready access or no access at all to the non-insertion end of the seat. Accordingly, the size and materials of seat puller 100 may change depending upon the application in which the seat puller 100 is used.

What is claimed is:

1. An apparatus, comprising:

a slide lock jaw including a first half jaw and a second half jaw, each of the first half jaw and the second half jaw having a first end and a second end opposite to the first end and having a first wall and a second wall each extending between the first end and the second end;

wherein the slide lockjaw has a first, closed position whereby the first wall of the first half jaw faces and is in contact with the first wall of the second half jaw, and the second wall of the first half jaw faces and is in contact with the second wall of the second half jaw;

wherein the slide lockjaw has a second, open position whereby the first wall of the first half jaw faces and is spaced further apart from the first wall of the second half jaw at the second end than the first end, and the second wall of the first half jaw faces and is spaced further apart from the first wall of the second half jaw at the second end than the first end;

wherein at least one of:

the first half jaw includes a pivot extending from at least one of the first wall or the second wall near the first end of the first half jaw for engagement with a notch within the corresponding at least one of the first wall or the second wall of the second half jaw; or the second half jaw includes a pivot extending from at least one of the first wall or the second wall near the first end of the second half jaw for engagement with a notch within the corresponding at least one of the first wall or the second wall of the first half jaw;

wherein an interior surface of each of the first half jaw and the second half jaw is at least partially conical in shape such that an opening extends completely through the first end and the second end both when the slide lock jaw is in the first, closed position and when the slide lock jaw is in the second, open position.

2. The apparatus of claim 1 wherein each of the first half jaw and the second half jaw includes a flange portion located on an external surface at the second end.

3. The apparatus of claim 1 wherein the slide lock jaw includes a groove about an outer circumference thereof adjacent to the pivot, the apparatus further comprising:

a keeper spring mounted within the groove.

4. The apparatus of claim 1, further comprising:

a shaft having a circular outer circumference and including:

a central shaft region;

a land region extending from the central shaft region;

a cone shaft region extending from the land region; and an end stopper region about a circumference of an end of the cone shaft region opposite from the land region;

wherein the slide lock jaw includes a keeper spring;

wherein the interior surface is shaped to conform to an external surface of the cone shaft region;

wherein the slide lock jaw is slidingly held against the shaft for rotation about the pivot by engagement of the keeper spring with each of the first half jaw and the second half jaw such that the slide lockjaw in sliding engagement with the land region when in the first, closed position and is in sliding engagement with the cone shaft region and in contact with the end stopper region when in the second, open position.

5. An apparatus, comprising:

a shaft having a circular outer circumference and including:

a central shaft region;

a land region extending from the central shaft region;

a cone shaft region extending from the land region; and an end stopper region about a circumference of an end of the cone shaft region opposite from the land region; and a slide lock jaw including two half jaws, a pivot and a keeper spring, each half jaw having an interior surface shaped to conform to an external surface of the cone shaft region;

wherein the slide lockjaw is slidingly held against the shaft for rotation about the pivot by engagement of the keeper spring with each of the two half jaws such that the slide lockjaw has a first, closed position in sliding engagement with the land region and a second, open position in sliding engagement with the cone shaft region and in contact with the end stopper region.

6. The apparatus of claim 5, further comprising:

a drop stop collar attached to the shaft at the central shaft region.

7. The apparatus of claim 6 wherein the shaft includes an adjusting nut fastening region having threads extending from the land region in a direction opposite to the land region, apparatus further comprising:

an adjusting nut threadingly attached to the threads of the adjusting nut fastening region.

8. The apparatus of claim 5 wherein the land region has an outside diameter smaller than that of the central shaft region and an outside diameter of the end stopper region is at least as large as that of the central shaft region.

9. The apparatus of claim 5 wherein the end stopper region includes a flange in contact with the end of the cone shaft region.

10. The apparatus of claim 9 wherein the shaft and slide lock jaw are sized so that the end stopper region extends through a central aperture of a seat while the slide lockjaw is in the first, closed position and so that moving the shaft in a direction of the seat forces the slide lock jaw to slide from the first, closed position to the second, open position by sliding movement of the interior surfaces of the two half jaws with the exterior surface of the cone shaft region and by expansion of the keeper spring until flanges on an outer surfaces of the two half jaws engage with an edge of the seat.

11. The apparatus of claim 5 wherein:

the shaft has a first end and an opposite second end defined by the end stopper region;

the pivot is adjacent to an edge of the slide lock jaw that is closer to the first end than the second end; and the slide lockjaw includes a groove about a circumference thereof adjacent to the pivot, the keeper spring mounted within the groove.

12. The apparatus of claim 5 wherein:

the shaft has a first end and an opposite second end defined by the end stopper region; and each of the two half jaws includes a flange portion located on an edge that is closer to the second end than the first end.

13. The apparatus of claim 5, further comprising:

an actuator coupled to the shaft to move the shaft in parallel with an axis of the shaft.

14. The apparatus of claim 5 wherein the shaft includes an adjusting nut fastening region having threads extending from the land region in a direction opposite to the land region, the seat puller further comprising:

an adjusting nut threadingly attached to the threads of the adjusting nut fastening region.

15. The apparatus of claim 14, further comprising:

a hydraulic pancake jack fitted over the adjusting nut fastening region, the adjusting nut securing the shaft to the hydraulic pancake jack.

16. A method, comprising:

inserting a slide lockjaw through a first end of an annular seal affixed to a housing wherein the slide lockjaw is mounted on a shaft having a circular outer circumference, the shaft includes a central shaft region, a land region extending from the central shaft region, a cone shaft region extending from the land region, and an end stopper region about a circumference of an end of the cone shaft region opposite from the land region, and the slide lockjaw includes two half jaws, a pivot and a keeper spring, each half jaw having an interior surface shaped to conform to an external surface of the cone shaft region and the slide lockjaw is slidingly held against the shaft for rotation about the pivot by engagement of the keeper spring with each of the two half jaws;

extending the shaft toward the annular seal until the end stopper region extends from a second end of the annular seal while the slide lockjaw is in a first, closed position in sliding engagement with the land region;

raising the shaft away from the annular seal until the slide lockjaw is in a second, open position in sliding engagement with the cone shaft region and in contact with the end stopper region, an outer circumference of the slide lockjaw in contact with the internal surface of the annular seal; and removing the shaft and the annular seal from the housing while the slide lockjaw is in the second, open position.

17. The method of claim 16 wherein the shaft includes an adjusting nut fastening region having threads extending from the land region in a direction opposite to the land region, the method further comprising:

fitting a hydraulic pancake jack over the adjusting nut fastening region; and threadingly attaching an adjusting nut to the threads of the adjusting nut fastening region to secure the shaft to the hydraulic pancake jack.

18. The method of claim 17 wherein the hydraulic pancake jack extends and raises the jack.

19. The method of claim 16 wherein:

the shaft has a first shaft end and an opposite second shaft end defined by the end stopper region; and each of the two half jaws includes a flange portion located on an edge that is closer to the second shaft end than the first shaft end, the flange portion in contact with the second end of the annular seal when the slide lockjaw is in the second, open position.

20. The method of claim 16 wherein the land region has an outside diameter smaller than that of the central shaft region and an outside diameter of the end stopper region is at least as large as that of the central shaft region.

* * * * *